US008857812B2

(12) United States Patent
Yamamoto

(10) Patent No.: US 8,857,812 B2
(45) Date of Patent: Oct. 14, 2014

(54) SHEET FEEDER HAVING MANUAL FEED TRAY, AND IMAGE FORMING APPARATUS INCLUDING THE SAME

(75) Inventor: Kiyonori Yamamoto, Osaka (JP)

(73) Assignee: Kyocera Mita Corporation, Osaka-shi (JP)

( * ) Notice: Subject to any disclaimer, the term of this patent is extended or adjusted under 35 U.S.C. 154(b) by 432 days.

(21) Appl. No.: 13/093,881

(22) Filed: Apr. 26, 2011

(65) Prior Publication Data

US 2011/0266743 A1 Nov. 3, 2011

(30) Foreign Application Priority Data

Apr. 28, 2010 (JP) ..... 2010-103527

(51) Int. Cl.
*B65H 1/00* (2006.01)
*B65H 1/04* (2006.01)

(52) U.S. Cl.
CPC ..... *B65H 1/04* (2013.01); *B65H 2405/121* (2013.01); *B65H 2405/324* (2013.01)
USPC ..... 271/162; 271/9.09

(58) Field of Classification Search
USPC ..... 271/9.09, 162
See application file for complete search history.

(56) References Cited

U.S. PATENT DOCUMENTS 6,428,000 B1 * 8/2002 Hara et al. ..... 271/223
2006/0291342 A1 * 12/2006 Kang ..... 369/30.78

FOREIGN PATENT DOCUMENTS

JP 2001220047 8/2001
JP 2009-96598 5/2009

* cited by examiner

*Primary Examiner* — Michael McCullough
*Assistant Examiner* — Howard Sanders
(74) *Attorney, Agent, or Firm* — Gerald E. Hespos; Michael J. Porco; Matthew T. Hespos

(57) ABSTRACT

A sheet feeder includes: a housing; a sheet feeding mechanism and a manual feed tray and that is mounted pivotably to the housing. The manual feed tray can assume a first posture that is closed relative to the housing, and a second posture that is open relative to the housing. A link couples the housing with the manual feed tray and pivots with a pivoting movement of the manual feed tray to hold the second posture of the manual feed tray. A posture changing mechanism permits the manual feed tray to pivot farther in an opening direction from the second posture when a load acts on a sheet mounting surface and causes the manual feed tray to assume a third posture while being held by the link. A posture holding mechanism holds the third posture of the manual feed tray.

8 Claims, 10 Drawing Sheets

SHEET FEEDER HAVING MANUAL FEED TRAY, AND IMAGE FORMING APPARATUS INCLUDING THE SAME

BACKGROUND OF THE INVENTION

1. Field of the Invention

The present invention relates to a sheet feeder having a manual feed tray, and to an image forming apparatus including the sheet feeder.

2. Description of the Related Art

Image forming apparatuses such as a copying machine, a printer, and a facsimile machine include an image forming section that forms a toner image on a sheet of paper (sheet) and a paper feeder that feeds a sheet of paper to the image forming section. Generally, an image forming apparatus includes both a paper feeder that feeds a sheet of paper from a paper cassette to the image forming section and a paper feeder that feeds a sheet of paper from a manual feed tray on which the sheet of paper is mounted by a user to the image forming section.

As a conventional image forming apparatus, an apparatus is known in which a manual feed tray is provided on a front cover of an apparatus main body and an opening operation for pulling down the manual feed tray from the front cover is to be performed in two stages. Accordingly, an impact caused when pulling down the manual feed tray is suppressed. As a result, an impact sound is suppressed and, at the same time, an impact acting on components of the manual feed tray is suppressed.

However, in the conventional image forming apparatus, the manual feed tray and the front cover are coupled by a link lever. Therefore, when a large load acts on a sheet mounting surface of the manual feed tray in a state where the manual feed tray is assuming an open posture, the load is transferred to the front cover via the link lever. Therefore, the front cover may open inadvertently.

A paper conveying path for conveying a sheet of paper is provided on a rear face of the front cover which faces the inside of the apparatus main body. A plurality of conveying rollers is arranged on the paper conveying path. Each of the plurality of conveying rollers is in contact at a predetermined contact pressure with a corresponding conveying roller arranged on the side of the apparatus main body. Therefore, when the front cover inadvertently opens due to the load, an impact generated upon the opening of the front cover may disrupt a contact pressure balance between the conveying rollers and may create a gap between the conveying rollers. Disruption of contact pressure balance causes paper conveyance failure. In addition, the impact generated upon the opening of the front cover may damage components such as the link lever.

SUMMARY OF THE INVENTION

An object of the present invention is to provide a paper feeder capable of suppressing inconveniences such as damage to parts or paper conveyance failure which may occur due to a load acting on a manual feed tray, and an image forming apparatus including the paper feeder.

In order to achieve the object described above, a paper feeder according to an aspect of the present invention includes: a housing; a sheet feeding mechanism that is arranged in the housing and that feeds a sheet in a predetermined direction; a manual feed tray that has a sheet mounting surface on which the sheet to be fed is mounted and that is pivotably mounted to the housing, the manual feed tray being configured to assume a first posture in which the manual feed tray becomes closed with respect to the housing, and to pivot and assume a second posture in which the manual feed tray becomes open with respect to the housing when in use during which the sheet is mounted on the sheet mounting surface; a link member that couples the housing with the manual feed tray, the link member being pivotably mounted to the housing and pivoting in accordance with a pivoting movement of the manual feed tray to hold the second posture of the manual feed tray; a posture changing mechanism that permits the manual feed tray to pivot further in an opening direction from the second posture when a load acts on the sheet mounting surface in a state where the manual feed tray is assuming the second posture, and that causes the manual feed tray to assume a third posture while the manual feed tray is held by the link member; and a posture holding mechanism that holds the third posture of the manual feed tray.

In addition, an image forming apparatus according to another aspect of the present invention includes: an apparatus main body; an image forming section that is arranged in the apparatus main body and that forms an image on a sheet; a cover member that is provided so as to be openable and closeable with respect to the apparatus main body and that has a sheet conveying path for conveying the sheet to the image forming section; and a sheet feeder that feeds the sheet to the image forming section and that is configured as described above, wherein a first conveying roller for conveying the sheet is provided on the sheet conveying path, and a second conveying roller that contacts the first conveying roller at a predetermined contact pressure is arranged on the apparatus main body.

DETAILED DESCRIPTION OF THE PREFERRED EMBODIMENTS

Figure 1:
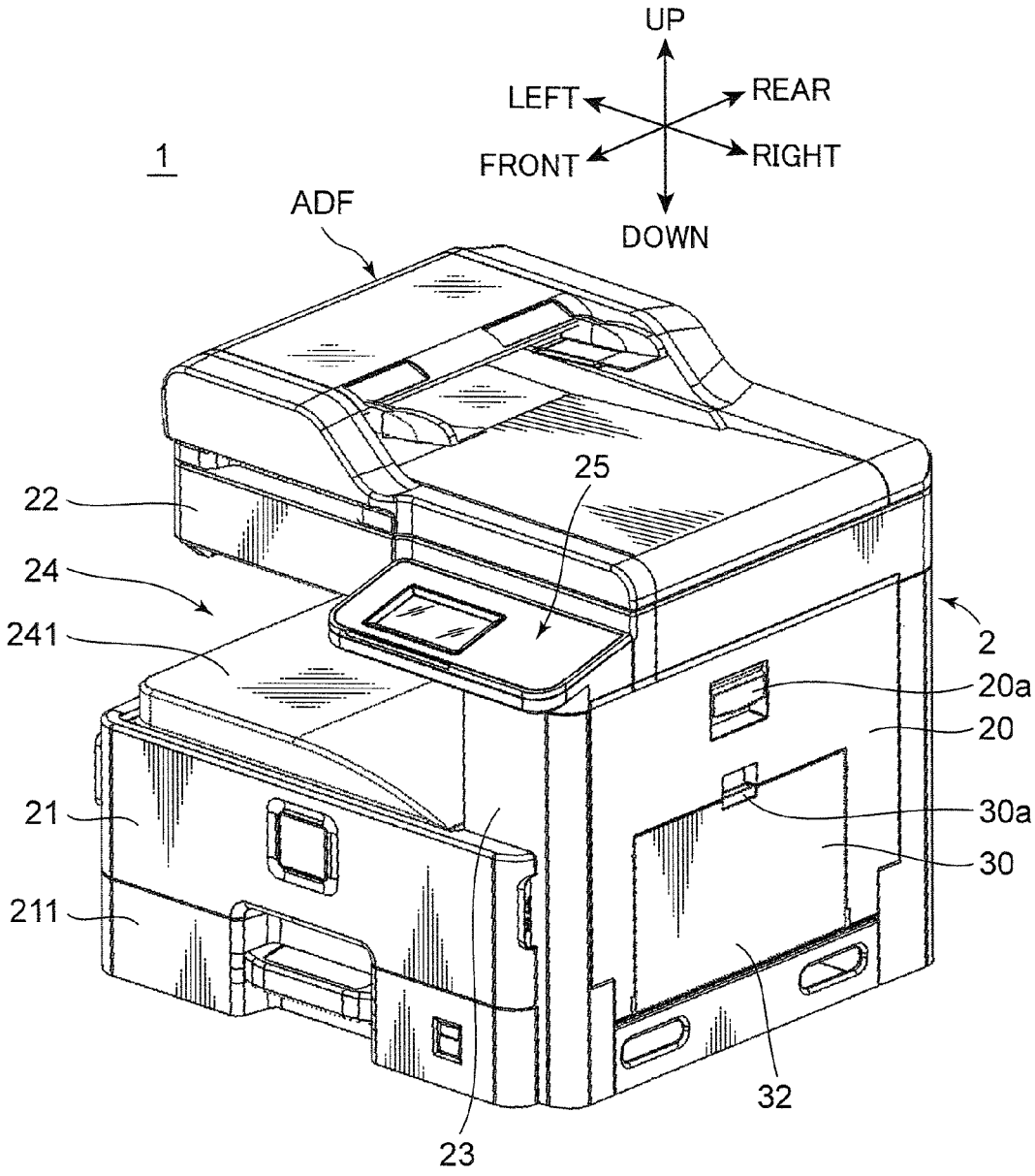
FIG. 1 is a perspective view showing an exterior of an image forming apparatus according to an embodiment of the present invention.
Figure 2:
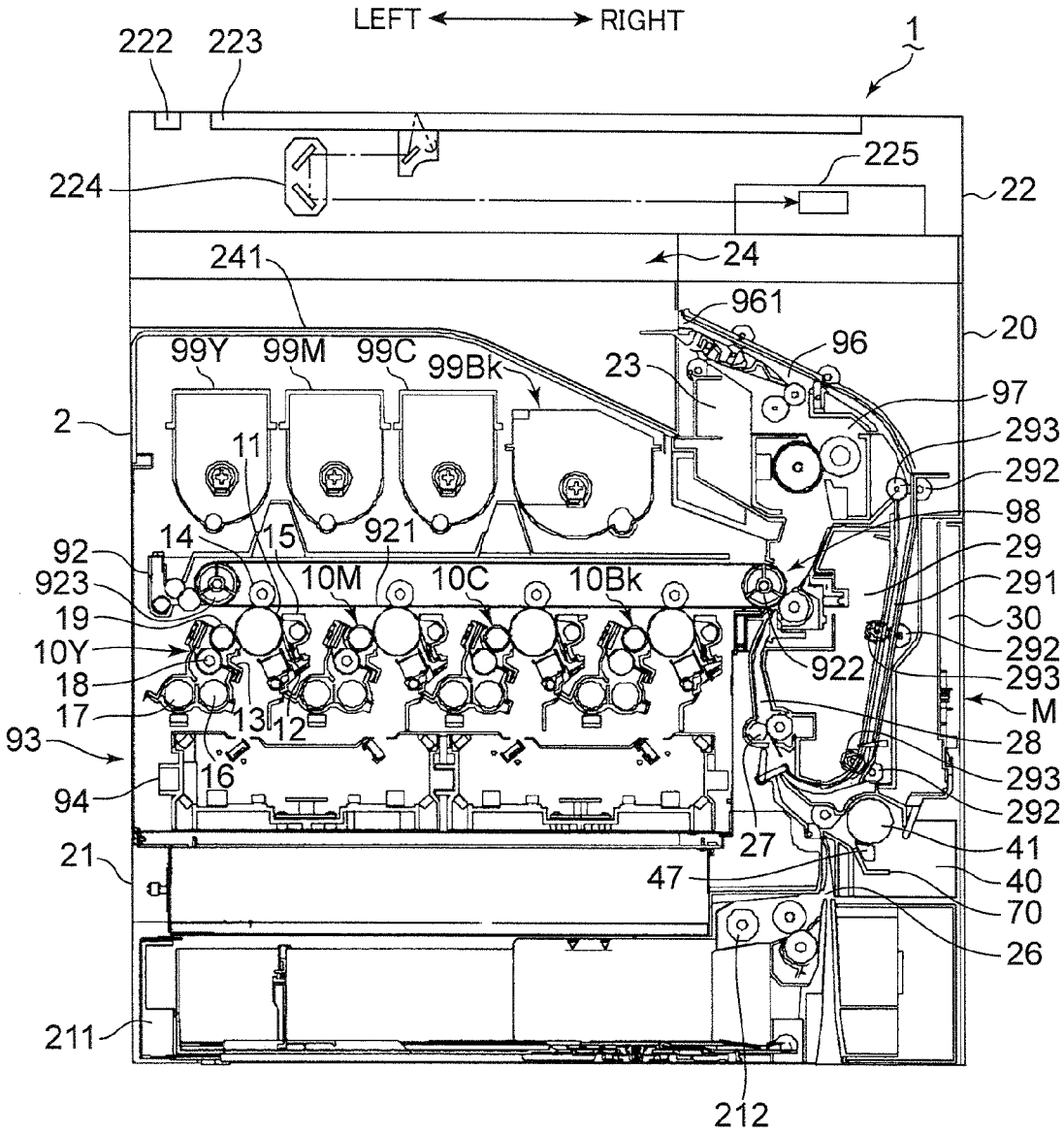
FIG. 2 is a cross-sectional view showing an internal structure of the image forming apparatus.

Hereinafter, embodiments of the present invention will be described in detail with reference to the drawings. FIG. 1 is a perspective view showing an exterior of an image forming apparatus 1 according to an embodiment of the present invention, and FIG. 2 is a cross-sectional view showing an internal structure of the image forming apparatus 1. While a so-called internal paper-ejection type copying machine is exemplified as the image forming apparatus 1 in the drawings, the image forming apparatus may alternatively be a printer, a facsimile machine, or a multifunction machine including functions thereof.

The image forming apparatus 1 has an approximately box-shaped housing structure and includes an apparatus main body 2 (housing) having an internal space (an internal paper ejecting section 24). The apparatus main body 2 performs an image forming process on a sheet of paper (sheet). The apparatus main body 2 includes an approximately cuboid lower housing 21, an approximately cuboid upper housing 22 arranged above the lower housing 21, and a coupling housing 23 that couples the lower housing 21 with the upper housing 22. Various devices for forming an image are housed in the lower housing 21, and various devices for optically reading a document image are housed in the upper housing 22. An internal space enclosed by the lower housing 21, the upper housing 22, and the coupling housing 23 constitutes the internal paper ejecting section 24 capable of housing the sheet of paper after image formation. The coupling housing 23 is arranged on the side of a right side face of the apparatus main body 2 and is provided with an ejecting outlet 961 for ejecting the sheet of paper to the internal paper ejecting section 24.

The internal space that is used as the internal paper ejecting section 24 is opened to the outside at the front face and the left side face of the apparatus main body 2. The user can reach in from these open portions to retrieve the sheet of paper after image formation from the internal paper ejecting section 24. A bottom face 241 of the internal space is defined by an upper face of the lower housing 21. Sheets of paper ejected from the ejecting outlet 961 are to be stacked on the bottom face 241.

An operating panel unit 25 is provided on a front face of the upper housing 22 so as to protrude therefrom. The operating panel unit 25 includes operating keys such as a numerical keypad and a start key as well as an LCD touch panel or the like, and accepts input of various operation instructions from the user. The user is able to input the number of sheets of paper to be printed or input a print lightness/darkness setting or the like using the operating panel unit 25. An automatic document feeder ADF (not shown in FIG. 2) is installed above the upper housing 22. The ADF is mounted at a rear end edge thereof to the upper housing 22 so as to be pivotable with respect to the upper housing 22.

A paper feeding cassette 211 that houses sheets of paper on which an image forming process is to be performed is mounted to the lower housing 21. The paper feeding cassette 211 can be pulled out frontward from a front face of the lower housing 21. The paper feeding cassette 211 is a cassette provided for automatic paper feeding.

A paper feeder M (sheet feeder) that enables a user to perform manual paper feeding is mounted to the right side face of the apparatus main body 2. The paper feeder M includes a manual feed tray 30 on which a manually-fed sheet of paper is mounted, and a paper feeding mechanism 40 (sheet feeding mechanism) for conveying the manually-fed sheet of paper to a secondary transfer section 98 inside the lower housing 21.

A side face cover 20 (cover member) is mounted to the right side face of the apparatus main body 2 so as to be openable/closeable with respect to the apparatus main body 2 at pivot points located in a lower end part of the side face cover 20. When subjected to a downward pull-down force having a gripping part 20*a* as a gripping part, the side face cover 20 pivots around the pivot points and changes to an open state. The side face cover 20 is set to an open state during maintenance of the image forming apparatus 1 or the like. The manual feed tray 30 of the paper feeder M is mounted at a lower end part thereof to the side face cover 20 so as to be both openable/closeable and pivotable. When performing manual paper feeding, the user grips a gripping part 30*a* and pulls the manual feed tray 30 downward to set the manual feed tray 30 to an open state, and mounts a sheet of paper onto the manual feed tray 30. The paper feeder M will be described in detail with reference to FIG. 3 and thereafter.

Next, an internal structure of the apparatus main body 2 will be described with reference to FIG. 2. Toner containers 99Y, 99M, 99C, and 99Bk, an intermediate transfer unit 92, an image forming unit 93, an exposure unit 94, and the paper feeding cassette 211 described above are housed in this order from top to bottom inside the lower housing 21.

For the purpose of forming a full-color toner image, the image forming unit 93 includes four image forming units 10Y, 10M, 10C, and 10Bk which respectively form toner images of yellow (Y), magenta (M), cyan (C), and black (Bk). Each of the image forming units 10Y, 10M, 10C, and 10Bk include a photosensitive drum 11, as well as a charger 12, a developing device 13, a primary transfer roller 14, and a cleaning device 15 arranged around the photosensitive drum 11.

The photosensitive drum 11 rotates around an axis thereof, and an electrostatic latent image and a toner image are formed on a circumferential surface of the photosensitive drum 11. A photosensitive drum using an amorphous silicon (a-Si)-based material can be used as the photosensitive drum 11. The charger 12 uniformly charges the surface of the photosensitive drum 11. After charging, the circumferential surface of the photosensitive drum 11 is exposed by the exposure unit 94 to form an electrostatic latent image.

The developing device 13 supplies toner to the circumferential surface of the photosensitive drum 11 in order to develop the electrostatic latent image formed on the photosensitive drum 11. The developing device 13 is for a two-component developer and includes agitating rollers 16 and 17, a magnetic roller 18, and a developing roller 19. The agitating rollers 16 and 17 charge a toner by circulating and conveying the two-component developer while applying agitation. A circumferential surface of the magnetic roller 18 bears a two-component developer layer, and a circumferential surface of the developing roller 19 bears a toner layer formed when toner is transferred due to a difference in potential between the magnetic roller 18 and the developing roller 19. Toner on the developing roller 19 is supplied to the circumferential surface of the photosensitive drum 11 to develop the electrostatic latent image.

The primary transfer roller 14 forms a nip section together with the photosensitive drum 11 with an intermediate transfer belt 921 of the intermediate transfer unit 92 in-between, and performs a primary transfer of a toner image on the photosensitive drum 11 onto the intermediate transfer belt 921. The cleaning device 15 cleans the circumferential surface of the photosensitive drum 11 after toner image transfer.

A yellow toner container 99Y, a magenta toner container 99M, a cyan toner container 99C, and a black toner container 99Bk store toners of respective colors, and supply the toners of respective colors to developing devices 13 of the image forming units 10Y, 10M, 10C, and 10Bk corresponding to the respective YMCBk colors via supply paths (not shown).

The exposure unit 94 includes a light source and various optical devices such as a polygon mirror, a reflective mirror, and a deflecting mirror, and irradiates light based on image data of a document image on a circumferential surface of a photosensitive drum 11 provided at each of the image forming units 10Y, 10M, 10C, and 10Bk to form an electrostatic latent image.

The intermediate transfer unit 92 includes the intermediate transfer belt 921, a driving roller 922, and a driven roller 923. Toner images from the plurality of photosensitive drums 11 are overcoated on the intermediate transfer belt 921 (primary transfer). Secondary transfer of the overcoated toner images is performed by the secondary transfer section 98 onto a sheet of paper supplied from the paper feeding cassette 211 or the manual feed tray 30. The driving roller 922 and the driven roller 923 which revolvingly drive the intermediate transfer belt 921 are rotatably supported by the lower housing 21. The intermediate transfer unit 92, the image forming unit 93, the exposure unit 94, and the secondary transfer section 98 constitute an image forming section.

The paper feeding cassette 211 houses a paper stack in which a plurality of sheets of paper is stacked on top of each other. A pick-up roller 212 is arranged on an upper part of a right end of the paper feeding cassette 211. Due to driving of the pick-up roller 212, an uppermost sheet of paper of the paper stack in the paper feeding cassette 211 is fed one by one and sent into an inward conveying path 26. On the other hand, a sheet of paper mounted on the manual feed tray 30 is sent into the inward conveying path 26 by the paper feeding roller 41 of the paper feeding mechanism 40 and a separation pad 47.

A paper conveying path 28 that reaches the ejecting outlet 961 via the secondary transfer section 98 and a fixing unit 97 and a paper ejecting unit 96 to be described later is provided on a downstream side of the inward conveying path 26. An upstream portion of the paper conveying path 28 is formed between an inner wall formed on the lower housing 21 and an inner wall that forms an inside face of a reverse conveying unit 29. A resist roller pair 27 is arranged on an upstream side of the paper conveying path 28 at a position further upstream than the secondary transfer section 98. A sheet of paper is temporarily stopped at the resist roller pair 27, and after being subjected to skew correction, the sheet of paper is sent out to the secondary transfer section 98 at a predetermined timing for image transfer.

In addition, a reverse conveying path 291 that conveys a sheet of paper in reverse during duplex printing is provided from the paper ejecting unit 96 to a vicinity of the resist roller pair 27. One side of the reverse conveying path 291 is constituted by an outside face of the reverse conveying unit 29, and another side of the reverse conveying path 291 is constituted by an inner wall face of the side face cover 20 which faces the inside of the lower housing 21. A plurality of conveying rollers (first conveying rollers) 292 is arranged along the reverse conveying path 291 on the inner wall face of the side face cover 20, and a plurality of conveying rollers (second conveying rollers) 293 that contacts corresponding conveying rollers 292 at a predetermined contact pressure is arranged on the outer face of the reverse conveying unit 29.

The fixing unit 97 and the paper ejecting unit 96 are housed inside the coupling housing 23. The fixing unit 97 includes a fixing roller and a pressure roller, and performs a fixing process by heating and pressurizing a sheet of paper onto which a toner image has been transferred by secondary transfer by the secondary transfer section 98. The sheet of paper with a color image which has been subjected to the fixing process is ejected by the paper ejecting unit 96 arranged on a downstream side of the fixing unit 97 from the ejecting outlet 961 toward the internal paper ejecting section 24.

A first contact glass 222 and a second contact glass 223 are fitted into the upper face of the upper housing 22. The first contact glass 222 is provided for reading a document sheet automatically fed from the automatic document feeder ADF (FIG. 1). The second contact glass 223 is provided for reading a document sheet placed manually.

A scanning mechanism 224 and an imaging element 225 for optically reading document information are housed inside the upper housing 22. The scanning mechanism 224 includes a light source, a moving carriage, a reflective mirror, and the like, and guides light reflected off of a document to the imaging element 225. The imaging element 225 photoelectrically converts the reflected light into an analog electric signal. The analog electric signal is converted into a digital electric signal by an A/D converter circuit (not shown) and input to the exposure unit 94.

Figure 3:
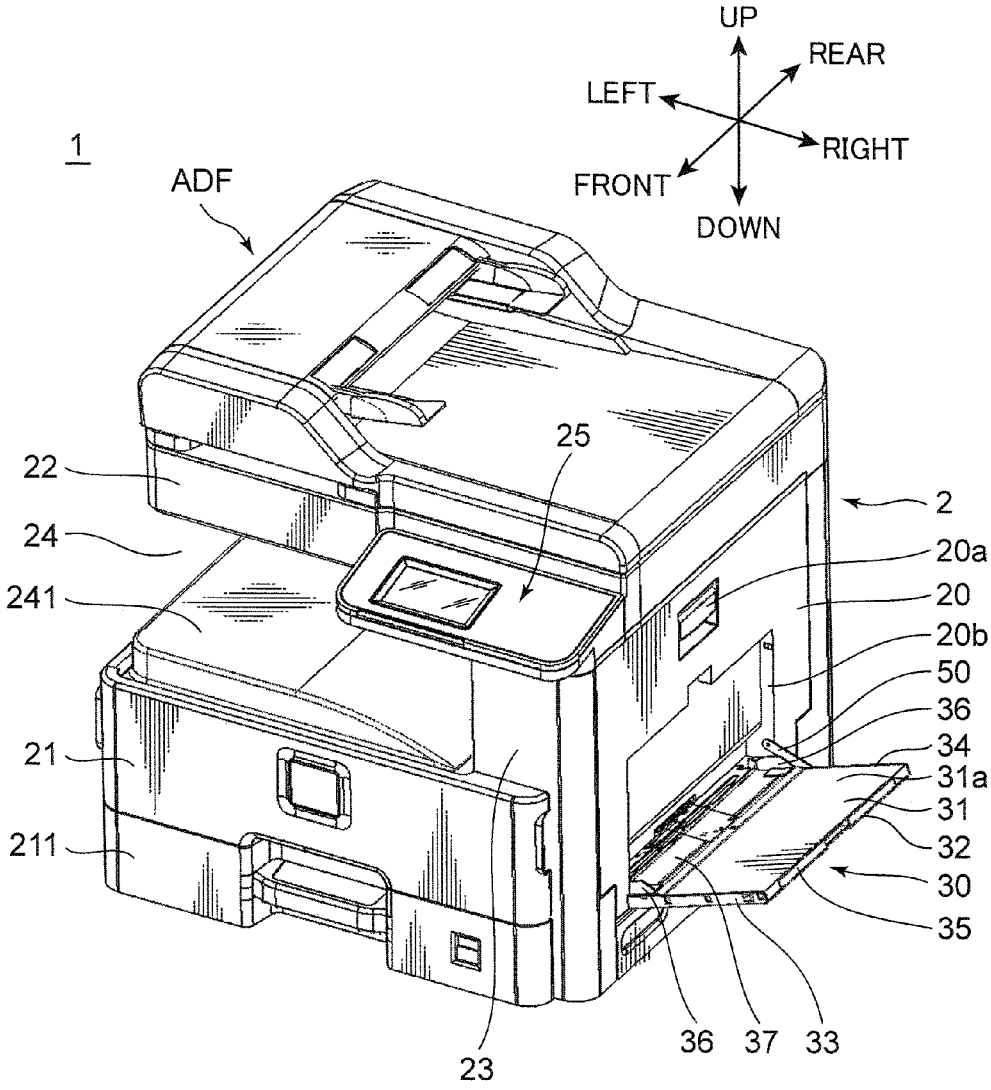
FIG. 3 is an external perspective view of the image forming apparatus showing a state where a manual feed tray is assuming a second posture.
Figure 4:
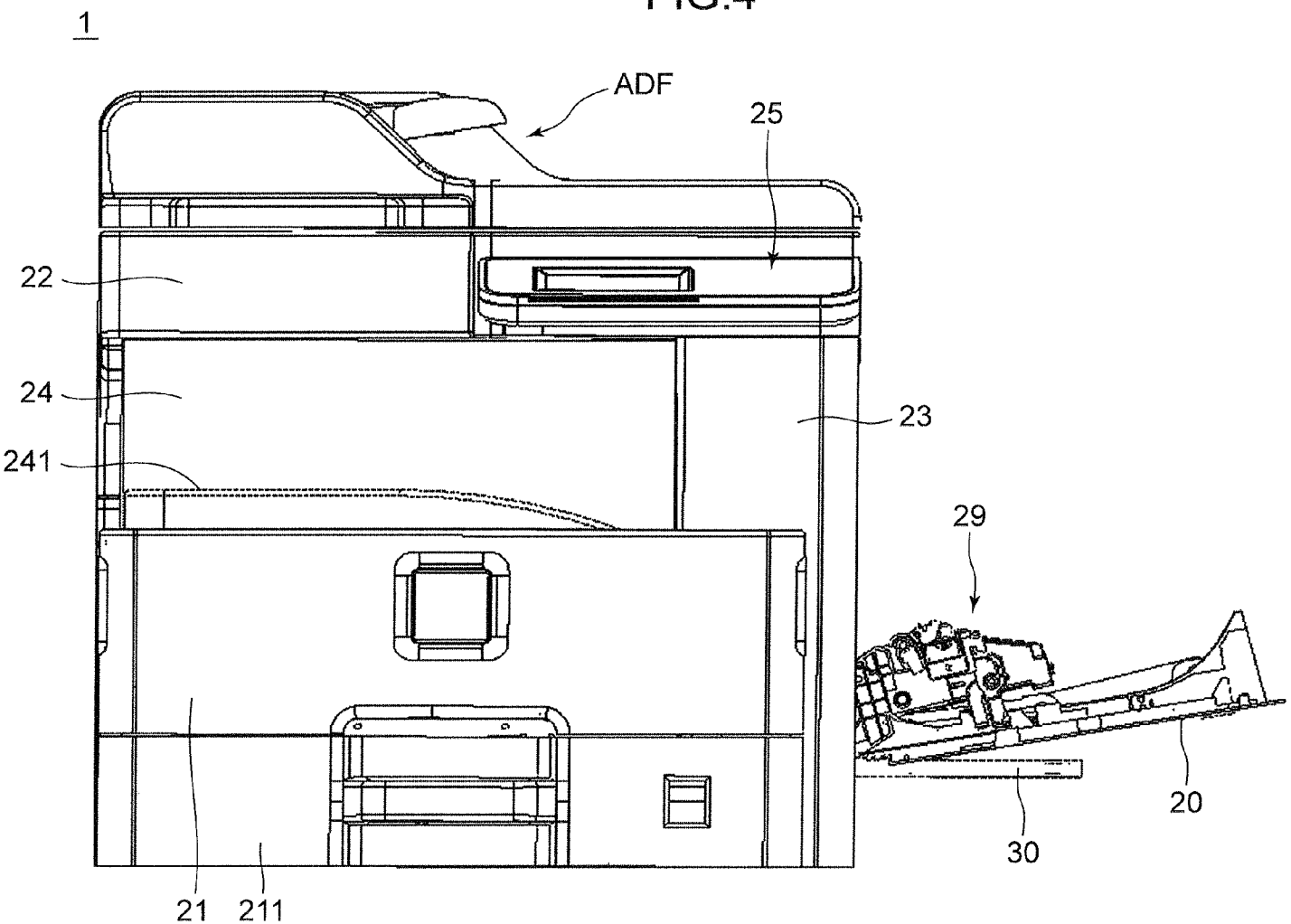
FIG. 4 is a side view of the image forming apparatus showing a state where the manual feed tray is assuming a third posture.

The paper feeder M and, in particular, the manual feed tray 30, will now be described with reference to FIGS. 3 to 12. First, the manual feed tray 30 will be described with reference to FIGS. 3 and 4 in addition to FIG. 1. FIG. 3 is an external perspective view of the image forming apparatus 1 showing a state where the manual feed tray 30 is assuming a second posture. FIG. 4 is a side view of the image forming apparatus 1 showing a state where the manual feed tray 30 is assuming a third posture.

As shown in FIG. 1, when the manual feed tray 30 is not being used to feed a sheet of paper, the manual feed tray 30 assumes a first posture in which the manual feed tray 30 is closed with respect to the side face cover 20. In addition, as shown in FIG. 3, when the manual feed tray 30 is used to feed a sheet of paper, the manual feed tray 30 is pulled downward or, in other words, pivots downward, and assumes a second posture in which the manual feed tray 30 becomes open with respect to the side face cover 20. When assuming the second posture, the manual feed tray 30 is tilted downward so as to form a predetermined angle with respect to a horizontal plane. The paper feeding mechanism 40 of the paper feeder M feeds a sheet of paper when the manual feed tray 30 is assuming the second posture. Furthermore, as shown in FIG. 4, the manual feed tray 30 is capable of assuming a third posture in which the manual feed tray 30 is further pivoted in an opening direction from the second posture and extends in an approximately horizontal direction.

As shown in FIG. 3, the manual feed tray 30 is a member having a flattened rectangular box-like appearance and includes a first flat plate 31, a second flat plate 32, a front side plate 33, and a rear side plate 34.

The first flat plate 31 is a plate-like member extending in a front-rear direction of the image forming apparatus 1 (a width direction of a sheet of paper mounted on the manual feed tray 30). The first flat plate 31 faces the inside of the apparatus main body 2 when the manual feed tray 30 is assuming the first posture shown in FIG. 1 and faces upward when the manual feed tray 30 is assuming the second posture shown in FIG. 3. The first flat plate 31 has a sheet mounting surface 31*a* on which sheets of paper are to be mounted.

The second flat plate 32 is a plate-like member which extends in a front-rear direction of the image forming apparatus 1 and which opposes the first flat plate 31. The second flat plate 32 faces the outside of the apparatus main body 2 when the manual feed tray 30 is assuming the first posture and faces downward when the manual feed tray 30 is assuming the second posture.

The front side plate 33 couples a front edge part of the first flat plate 31 with a front edge part of the second flat plate 32. The rear side plate 34 couples a rear edge part of the first flat plate 31 with a rear edge part of the second flat plate 32.

An auxiliary tray 35 is extractably housed between the first flat plate 31 and the second flat plate 32. The auxiliary tray 35 can be extracted in an opposite direction to the apparatus main body 2 in a state where the manual feed tray 30 is assuming the second posture.

A pair of width cursors 36 is arranged on a downstream edge of the first flat plate 31 which is positioned on a downstream side in a paper feeding direction in which a sheet of paper mounted on the sheet mounting surface 31*a* is retrieved and fed by the paper feeding mechanism 40 (FIG. 2). The pair of width cursors 36 is configured so as to be slidable on a supporting flat plate 37 arranged on the downstream side of the first flat plate 31 as seen in a paper feeding direction, and moves in accordance of a width of the sheet of paper mounted on the sheet mounting surface 31*a* and gently holds the sheet of paper in a width direction.

Figure 5:
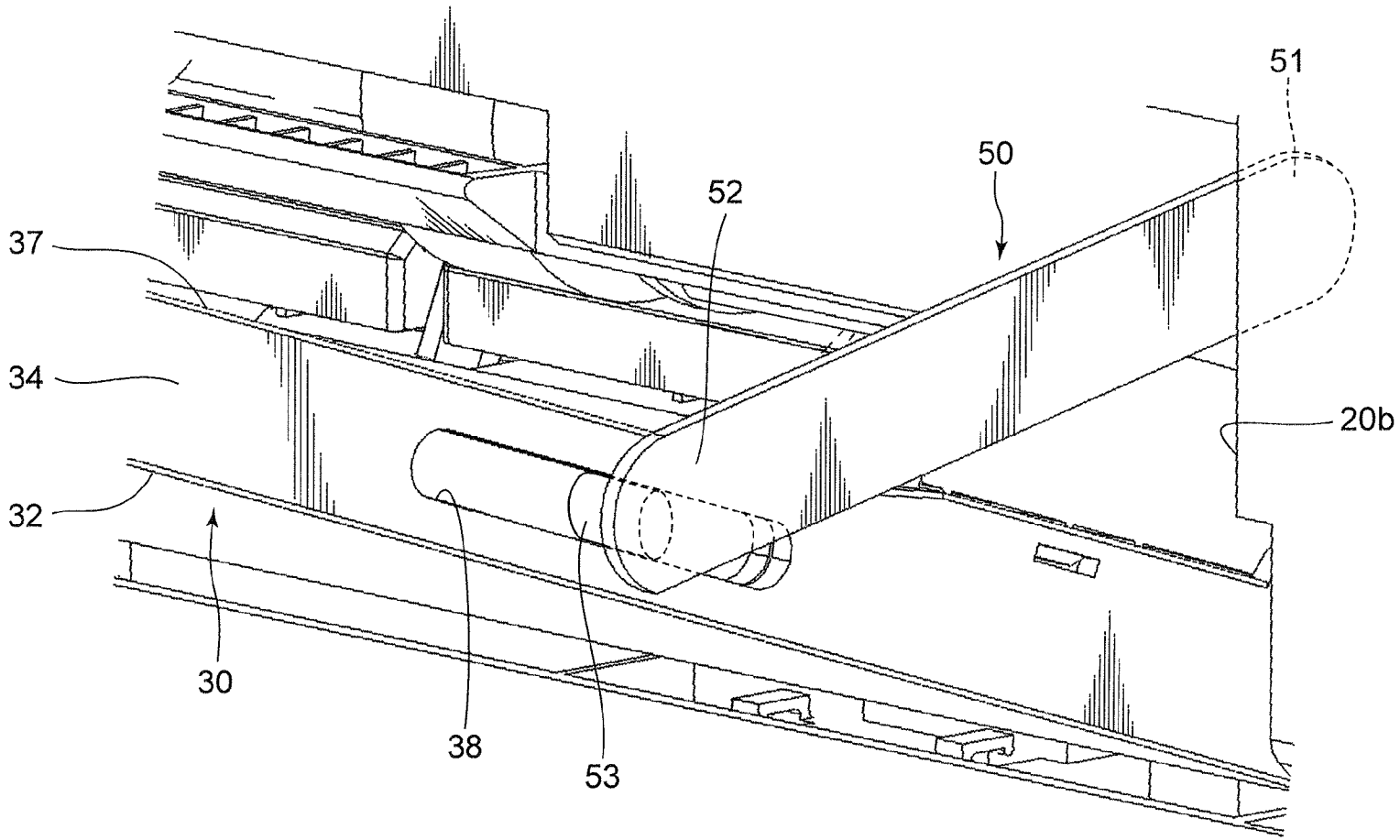
FIG. 5 is a partially enlarged view of the manual feed tray showing a state where the manual feed tray is held in the second posture by a link member.

The paper feeder M further includes a link member 50. The link member 50 couples the side face cover 20 of the apparatus main body 2 and the manual feed tray 30 to each other, and when the manual feed tray 30 has assumed the second posture in a state where a predetermined angle is formed with respect to a horizontal plane, holds the manual feed tray 30 in the second posture. FIG. 5 is a partially enlarged view of the manual feed tray 30 showing a state where the manual feed tray 30 is held in the second posture by the link member 50. As shown in FIG. 5, the link member 50 is an elongated and thin plate-like member, and has a first end part 51 and a second end part 52 positioned opposite to the first end part 51.

The side face cover 20 has a space for housing the manual feed tray 30 when the manual feed tray 30 is assuming the first posture. The space is defined by a housing wall part 20*b* (FIG. 3) formed on the side face cover 20. A pivot axis 54 (FIG. 6) pivotably supported by the housing wall part 20*b* is provided on the first end part 51 of the link member 50. As a result, the link member 50 is pivotable with respect to the side face cover 20.

On the other hand, the second end part 52 of the link member 50 is mounted to the rear side plate 34 of the manual feed tray 30. Specifically, an elongated engagement hole 38 that extends in an extending direction of the rear side plate 34 is formed on the rear side plate 34, and a protrusion 53 that slidably engages the engagement hole 38 is formed on the second end part 52. During the engagement, the protrusion 53 penetrates to the inside of the manual feed tray 30 past the engagement hole 38. When the link member 50 pivots with a movement of the manual feed tray 30 from the first posture to the second posture, the protrusion 53 slides inside the engagement hole 38. A length of the engagement hole 38 is set according to a pivot angle of the link member 50 so as to enable the protrusion 53 to slide in accordance with a pivoting movement of the link member 50 while engaging the engagement hole 38.

Figure 6:
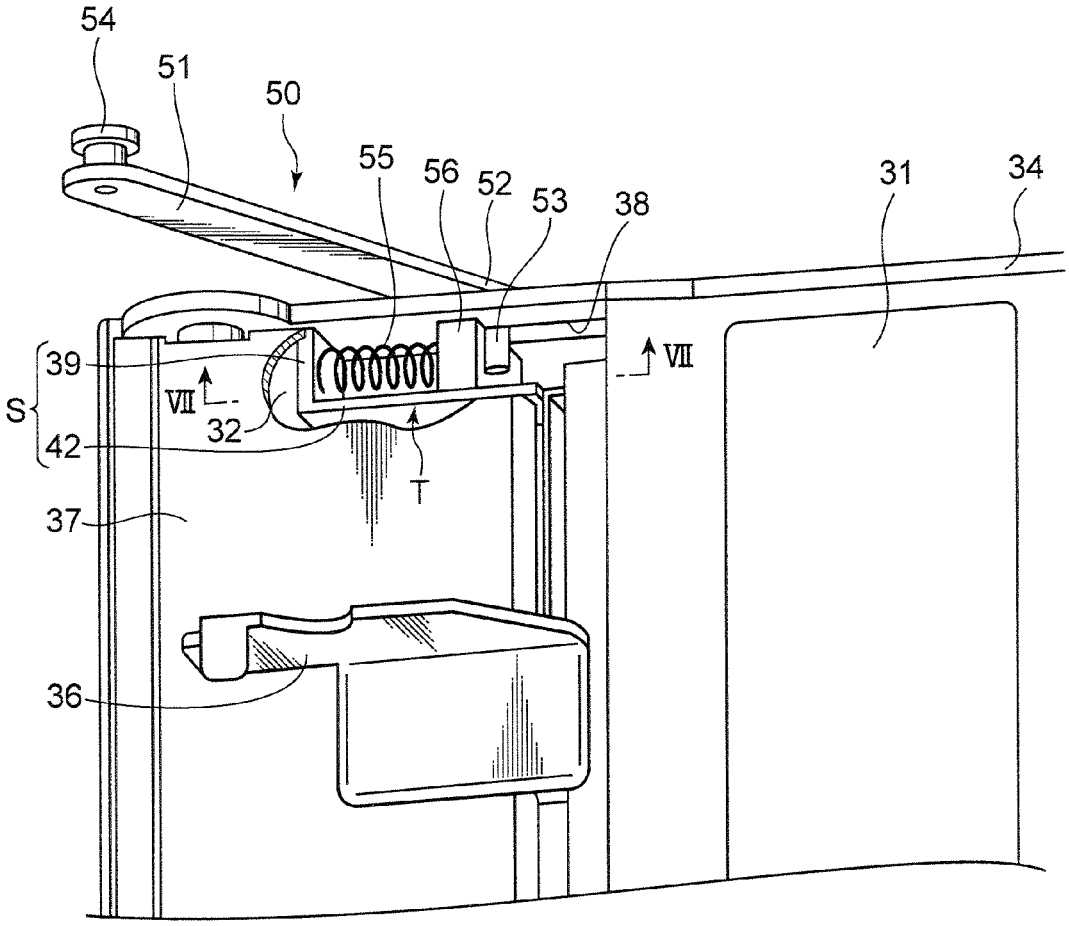
FIG. 6 is a top view of the manual feed tray showing a state where a protrusion of the link member is abutting a stopper piece of a posture changing mechanism.

In the present embodiment, the second posture of the manual feed tray 30 is held by having the protrusion 53 of the link member 50 abut a stopper piece 56 of a posture changing mechanism T arranged inside the manual feed tray 30 instead of by having the protrusion 53 of the link member 50 abut a longitudinal edge of the engagement hole 38. FIG. 6 is a top view of the manual feed tray 30 showing a state where the protrusion 53 of the link member 50 is abutting the stopper piece 56 of the posture changing mechanism T.

The posture changing mechanism T includes a housing section S, a spring member 55, and the stopper piece 56. The housing section S includes a first wall 39 (supporting portion) and a second wall 42.

The first wall 39 is a wall part which rises from the second flat plate 32 at a position directly underneath the supporting flat plate 37 and which extends from the rear side plate 34 in a direction approximately perpendicular to the rear side plate 34. The first wall 39 is integrally formed with the second flat plate 32 and the rear side plate 34. On the other hand, the second wall 42 is a wall part which rises from the second flat plate 32 and which extends approximately parallel to the rear side plate 34 toward an upstream side in a paper feeding direction from an end of the first wall 39 opposite to an end on the side of the rear side plate 34. The second wall 42 is integrally formed with the second flat plate 32. The spring member 55 and the stopper piece 56 are housed in a space defined by the first wall 39 and the second wall 42.

The spring member 55 (biasing mechanism/elastic member) has one end thereof supported by a face of the first wall 39 facing an upstream side in a paper feeding direction, and extends inside the housing section S along the engagement hole 38 of the rear side plate 34.

The stopper piece 56 is a block-like member fixed to another end of the spring member 55 and is therefore movable on an inner face-side of the rear side plate 34 along the engagement hole 38 with an expansion or contraction of the spring member 55. When the manual feed tray 30 assumes the second posture from the first posture, the stopper piece 56 is capable of abutting the protrusion 53 that slides inside the engagement hole 38 in accordance with a pivoting movement of the link member 50.

A biasing force of the spring member 55 is set to a level such that, in a state where the manual feed tray 30 has assumed the second posture from the first posture, the manual feed tray 30 can be prevented from further pivoting in an opening direction from the second posture due to a weight of sheets of paper mounted on the sheet mounting surface 31*a* (first load). Therefore, until the first load exceeds a predetermined weight, the spring member 55 holds the stopper piece 56 that is abutted by the protrusion 53 in an approximately extended state. Accordingly, the manual feed tray 30 is held in the second posture.

In addition, the biasing force of the spring member 55 is set so as to yield and cause the spring member 55 to contract when a second load that exceeds the first load acts on the sheet mounting surface 31*a*. Due to a contraction of the spring member 55, the manual feed tray 30 changes its posture from the second posture to the third posture.

Figure 7:
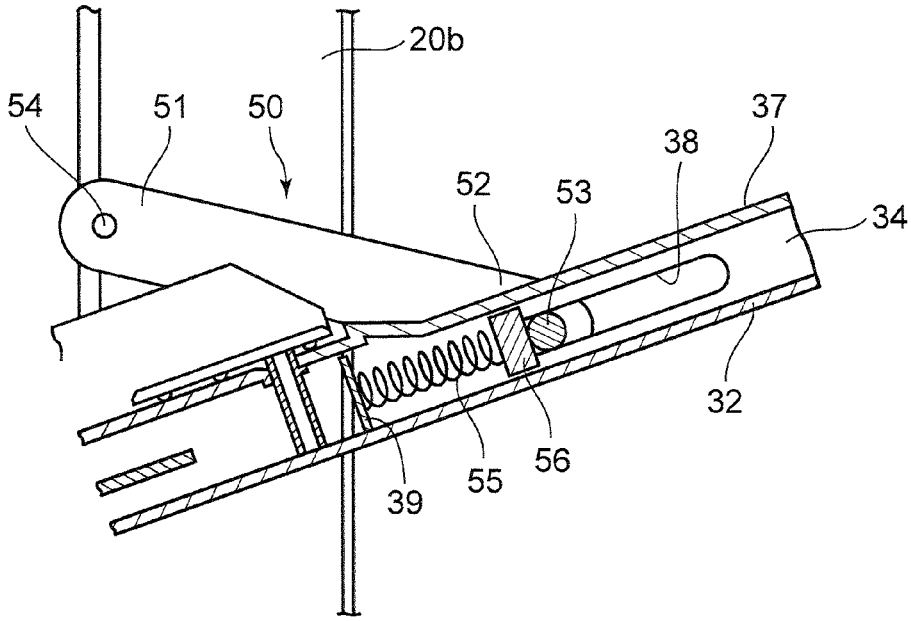
FIG. 7 is a cross-sectional view taken along VII-VII in FIG. 6 and showing a state where the manual feed tray has changed its posture from a first posture to a second posture.
Figure 8:
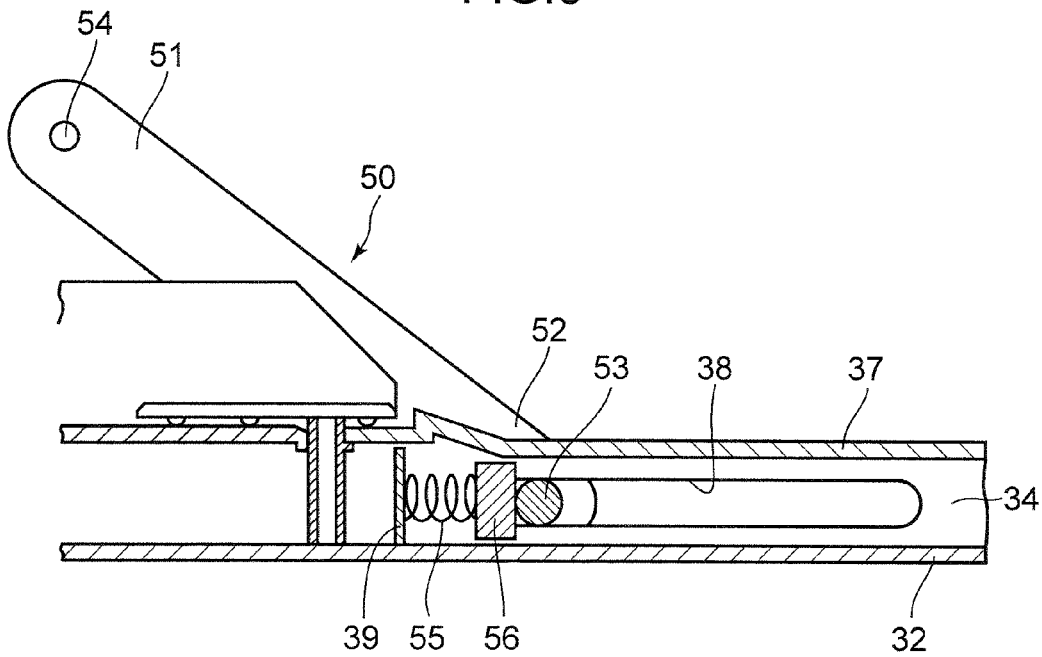
FIG. 8 is a cross-sectional view showing a state where the manual feed tray has changed its posture from the second posture shown in FIG. 7 to a third posture.

Next, an operation when the manual feed tray 30 assumes the second posture from the first posture and an operation when the manual feed tray 30 assumes the third posture from the second posture will be described with reference to FIGS. 7 and 8. FIG. 7 is a cross-sectional view cut along VII-VII in FIG. 6 and shows a state where the manual feed tray 30 has changed its posture from the first posture to the second posture. FIG. 8 shows a state where the manual feed tray 30 has changed its posture from the second posture shown in FIG. 7 to the third posture.

When the manual feed tray 30 changes its posture from the first posture to the second posture as shown in FIG. 7 and sheets of paper are mounted on the sheet mounting surface

31*a*, a load that acts on the sheet mounting surface 31*a* due to the sheets of paper (first load) is first transferred to the protrusion 53 of the link member 50 and then transferred to the stopper piece 56 abutting the protrusion 53, and attempts to compress the spring member 55 holding the stopper piece 56. However, as described above, since the biasing force of the spring member 55 is set to a level that prevents contraction of the spring member 55 due to the first load, the link member 50 does not pivot and the manual feed tray 30 is held in the second posture.

On the other hand, when the second load that exceeds the first load acts on the sheet mounting surface 31*a* in a state where the manual feed tray 30 is held in the second posture such as in a case where the user leans on the sheet mounting surface 31*a* or in a case where more than a predetermined number of sheets of paper is mounted on the sheet mounting surface 31*a*, the second load is transferred from the sheet mounting surface 31*a* to the protrusion 53 of the link member 50 and the protrusion 53 presses the stopper piece 56 and compresses the spring member 55 as shown in FIG. 8. Therefore, the stopper piece 56 moves in a contracting direction of the spring member 55, and the protrusion 53 abutting the stopper piece 56 also slides along the contracting direction inside the engagement hole 38. As a result, the link member 50 further pivots from the state where the link member 50 had been holding the manual feed tray 30 in the second posture. Therefore, the manual feed tray 30 further pivots in an opening direction from the second posture and assumes a third posture in which the manual feed tray 30 extends in an approximately horizontal direction.

As shown, using the biasing force of the spring member 55, the posture changing mechanism T both holds the manual feed tray 30 in the second posture and allows the manual feed tray 30 to change its posture from the second posture in the third posture.

Figure 9:
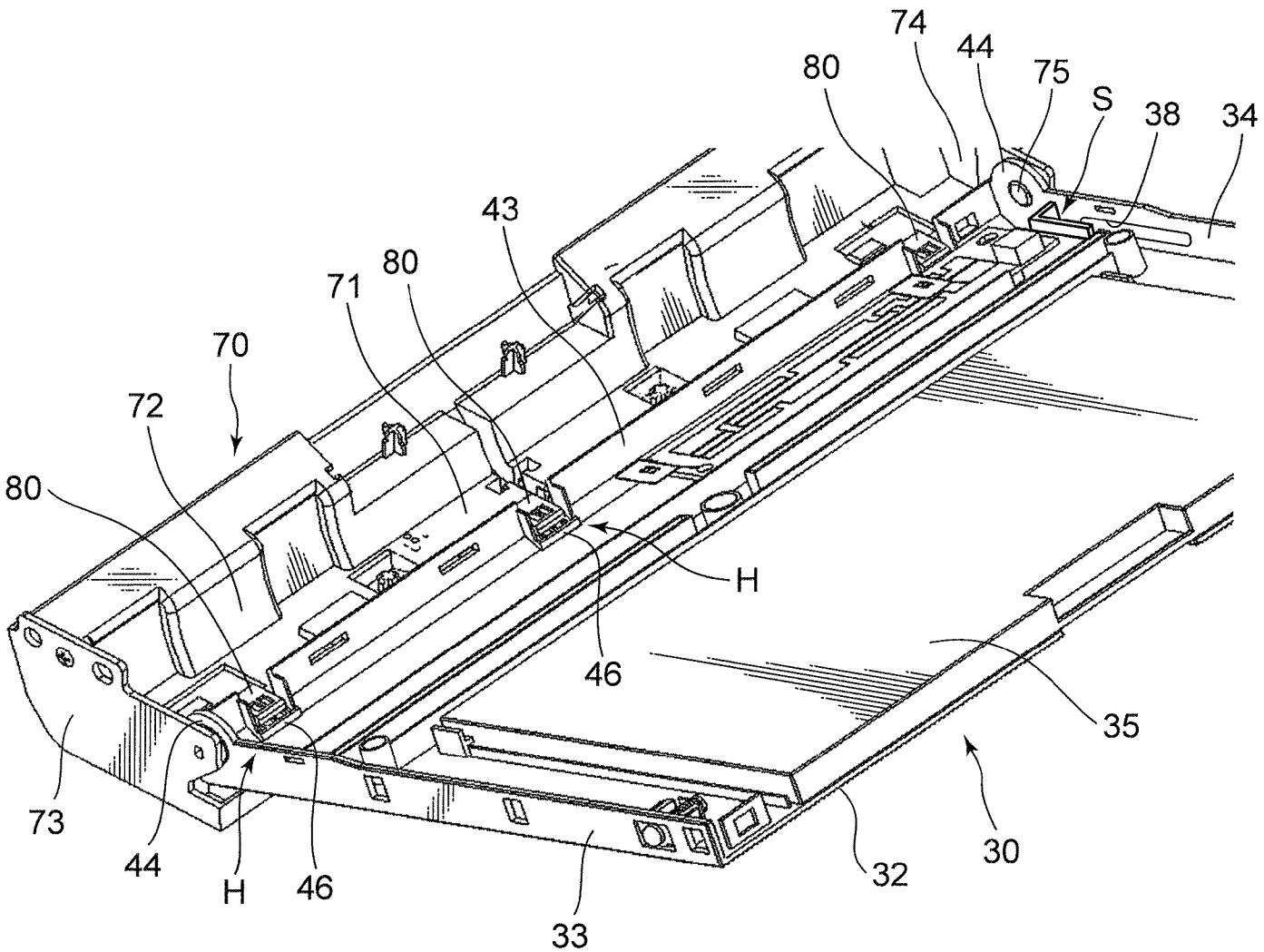
FIG. 9 is a perspective view of the manual feed tray and a supporting frame of a sheet feeding mechanism.
Figure 10:
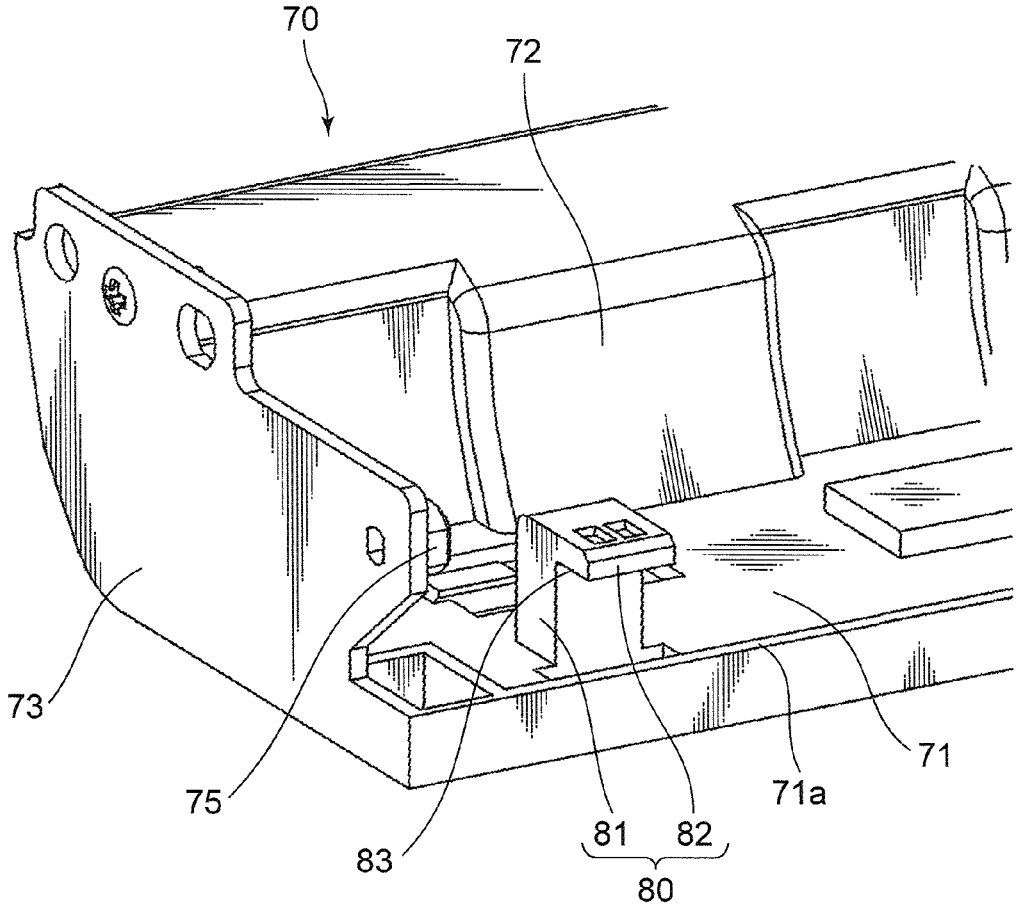
FIG. 10 is a perspective view showing an enlargement of apart of the supporting frame.

Next, a configuration that holds the manual feed tray 30 in the third posture will be described with reference to FIGS. 9 and 10. FIG. 9 is a perspective view of the manual feed tray 30 and a supporting frame 70 of the paper feeding mechanism 40. FIG. 10 is a perspective view showing an enlargement of a part of the supporting frame 70.

The manual feed tray 30 has a downstream-side edge part that is positioned on a downstream side as viewed in a paper feeding direction. A rising wall 43 that rises from the downstream-side edge part is formed on the downstream-side edge part. The rising wall 43 is notched in a plurality of locations (in FIG. 9, three locations). A protruding piece 46 that protrudes toward the sheet mounting surface 31*a* is integrally formed at each notched portion.

The paper feeding mechanism 40 includes the supporting frame 70 for supporting the paper feeding roller 41 and the separation pad 47 (FIG. 2). The supporting frame 70 is a member that extends along the rising wall 43 of the manual feed tray 30 and has a bottom wall 71, a first side plate 73 and a second side plate 74 which form a pair, and a coupling plate 72. The first side plate 73 and the second side plate 74 which form a pair respectively rise from both longitudinal ends of the bottom wall 71 and face each other. The coupling plate 72 rises from a downstream-side edge part of the bottom wall 71 which is positioned on a downstream side as viewed in a paper feeding direction and couples the first side plate 73 and the second side plate 74 to each other. Moreover, while the separation pad 47 is supported at an approximately central part of the coupling plate 72 in a longitudinal direction and the paper feeding roller 41 is supported by the supporting frame 70 in a state where the paper feeding roller 41 opposes and contacts the separation pad 47, for simplicity of illustration, the paper feeding roller 41 and the separation pad 47 have been omitted.

Pivot axis supporting sections 75 are integrally formed with the first side plate 73 and the second side plate 74 on the side of an upstream-side edge part 71*a* of the bottom wall 71. A pivoting section 44 having a shape capable of receiving the pivot axis supporting section 75 of the first side plate 73 is formed at a downstream-side end part of the front side plate 33 of the manual feed tray 30, and a pivoting section 44 having a shape capable of receiving the pivot axis supporting section 75 of the second side plate 74 is similarly formed at a downstream-side end part of the rear side plate 34 of the manual feed tray 30. The manual feed tray 30 is configured so as to be pivotable with respect to the side face cover 20 by pivoting while using the pivoting sections 44 as pivot points. The side face cover 20 is pivotable with respect to the apparatus main body 2 around a same axis as the pivoting sections 44.

A plurality of (in FIG. 9, three) claw parts 80 are erected along a longitudinal direction of the bottom wall 71 on the upstream-side edge part 71*a* of the bottom wall 71 of the supporting frame 70. Each claw part 80 includes a main body part 81 rising from the upstream-side edge part 71*a* and a claw piece 82 that extends from an upper part of the main body part 81 toward an upstream side in a paper feeding direction. The claw part 80 is engageable with a corresponding protruding piece 46 via a lower face 83 of the claw piece 82.

Figure 11:
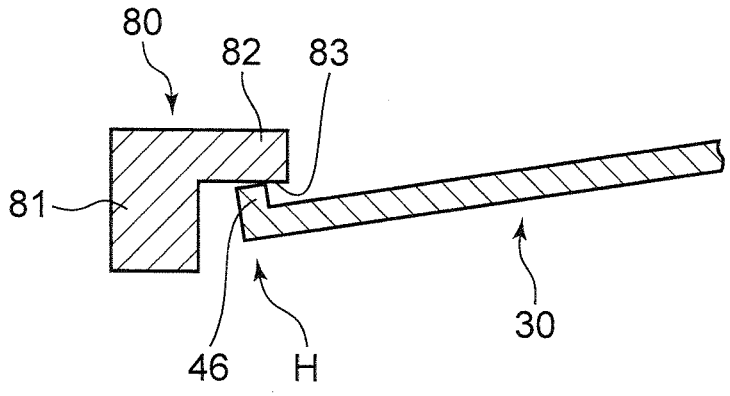
FIG. 11 is a schematic view showing a positional relationship between a protruding piece and a claw part when the manual feed tray is assuming the second posture.
Figure 12:
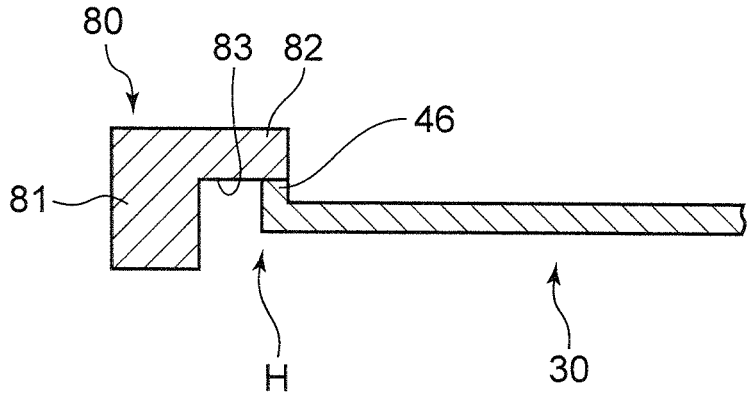
FIG. 12 is a schematic view showing a positional relationship between the protruding piece and the claw part when the manual feed tray is assuming the third posture.

Specifically, as shown in FIG. 11, when the manual feed tray 30 is assuming the second posture, the protruding piece 46 does not engage the claw part 80. On the other hand, as shown in FIG. 12, when the manual feed tray 30 is assuming the third posture, the protruding piece 46 engages the claw part 80.

As shown, in addition to the link member 50, by having the claw part 80 hold the protruding piece 46 in a state where the protruding piece 46 abuts the lower face 83 of the claw piece 82, the manual feed tray 30 is held in the third posture. In the present embodiment, the claw part 80 and the protruding piece 46 constitute the posture holding mechanism H that is capable of holding the manual feed tray 30 in the third posture.

In addition, since the protruding piece 46 abuts the lower face 83 of the claw piece 82, the manual feed tray 30 is prevented from further pivoting in an opening direction from the third posture. Therefore, when the user switches the manual feed tray 30 from the first posture to the second posture and mounts new sheets of paper onto the sheet mounting surface 31*a*, even if a second load acts on the sheet mounting surface 31*a* and the manual feed tray 30 assumes the third posture, the sheets of paper can be prevented from falling off the sheet mounting surface 31*a*.

Furthermore, since the manual feed tray 30 is capable of assuming the third posture as described above, by applying a load to the sheet mounting surface 31*a* and switching the manual feed tray 30 to the third posture, as shown in FIG. 4, a user or a maintenance personnel can open the side face cover 20 wider than in a configuration where the manual feed tray 30 is unable to assume the third posture. Accordingly, maintenance of the image forming apparatus 1 can be performed with ease. Moreover, while the reverse conveying unit 29 is positioned above the side face cover 20 in an open state in FIG. 4, the reverse conveying unit 29 is pivotable separately from the side face cover 20.

With the aforementioned paper feeder M according to the present embodiment, in the event that a second load acts on the sheet mounting surface 31*a* when the manual feed tray 30 is assuming the second posture, the posture changing mechanism T allows the manual feed tray 30 to further pivot in an opening direction from the second posture while compressing the spring member 55, and causes the manual feed tray 30 to assume the third posture. In addition, the third posture of the manual feed tray 30 is held by the posture holding mechanism H. Therefore, the second load is received by an engagement structure of the claw part 80 and the protruding piece 46 in the posture holding mechanism H. Accordingly, the second load is suppressed from being transferred from the manual feed tray 30 to the side face cover 20 via the link member 50. As a result, the side face cover 20 is suppressed from changing to an open state due to the second load. Furthermore, a variation in contact pressure balance between the conveying rollers 292 of the side face cover 20 and the conveying rollers 293 of the reverse conveying unit 29 due to a propagation of the second load to the side face cover 20 can be suppressed. Accordingly, the occurrence of a paper conveying failure can be suppressed.

Moreover, by simply adjusting biasing force so that the spring member 55 of the posture changing mechanism T yields to the second load when the manual feed tray 30 is subjected to the second load and assumes the third posture from the second posture, the posture of the manual feed tray 30 can be smoothly changed from the second posture to the third posture.

While an example in which the link member 50 and the posture changing mechanism T are provided on a side face of the rear end of the manual feed tray 30 has been illustrated, the link member 50 and the posture changing mechanism T may alternatively be provided on a side face of the front edge of the manual feed tray 30 or on both the front edge and the rear edge of the manual feed tray 30.

With the paper feeder M and the image forming apparatus 1 including the paper feeder M according to the present invention as described above, inconveniences such as damage to parts or paper conveyance failure which may occur due to a load acting on the manual feed tray 30 can be suppressed.

This application is based on Japanese Patent application No. 2010-103527 filed in Japan Patent Office on Apr. 28, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet feeder comprising:

a housing;

a sheet feeding mechanism that is arranged in the housing and that feeds a sheet in a predetermined direction;

a manual feed tray that has a sheet mounting surface on which the sheet to be fed is mounted and that is pivotably mounted to the housing, the manual feed tray being configured to assume a first posture in which the manual feed tray becomes closed with respect to the housing, and to pivot and assume a second posture in which the manual feed tray becomes open with respect to the housing when in use during which the sheet is mounted on the sheet mounting surface;

a link member that couples the housing with the manual feed tray, the link member being pivotably mounted to the housing and pivoting in accordance with a pivoting movement of the manual feed tray to hold the second posture of the manual feed tray;

a posture changing mechanism that permits the manual feed tray to pivot further in an opening direction from the second posture when a load acts on the sheet mounting surface in a state where the manual feed tray is assuming the second posture, and that causes the manual feed tray to assume a third posture while the manual feed tray is held by the link member; and a posture holding mechanism that holds the third posture of the manual feed tray, wherein the manual feed tray includes a downstream-side edge part positioned on a downstream side in a feeding direction of the sheet fed from the sheet mounting surface to the sheet feeding mechanism, and a protruding piece which is formed at the downstream-side edge part and which protrudes toward the side of the sheet mounting surface, the housing includes a claw part that engages with the protruding piece when the manual feed tray has assumed the third posture while the claw part does not engage with the protruding piece when the manual feed tray has assumed the second posture, the claw part holds the manual feed tray in the third posture in a state where the claw part engages the protruding piece, and the posture holding mechanism includes the claw part and the protruding piece.

2. The sheet feeder according to claim 1, wherein the third posture is a posture in which the manual feed tray is held in an approximately horizontal direction.

3. A sheet feeder comprising:

a housing;

a sheet feeding mechanism that is arranged in the housing and that feeds a sheet in a predetermined direction;

a manual feed tray that has a sheet mounting surface on which the sheet to be fed is mounted and that is pivotably mounted to the housing, the manual feed tray being configured to assume a first posture in which the manual feed tray becomes closed with respect to the housing, and to pivot and assume a second posture in which the manual feed tray becomes open with respect to the housing when in use during which the sheet is mounted on the sheet mounting surface;

a link member including a first end part pivotably mounted to the housing and a second end part mounted to the manual feed tray, the link member pivoting in accordance with a pivoting movement of the manual feed tray to hold the second posture of the manual feed tray; and a posture changing mechanism that permits the manual feed tray to pivot further in an opening direction from the second posture when a load acts on the sheet mounting surface in a state where the manual feed tray is assuming the second posture, and that causes the manual feed tray to assume a third posture while the manual feed tray is held by the link member, the posture changing mechanism including a biasing mechanism which biases the second end part of the link member so that the second posture of the manual feed tray is maintained when the manual feed tray assumes the second posture while being subjected to a first load, and whose biasing force that biases the second end part yields when the manual feed tray is subjected to a second load that exceeds the first load and changes its posture from the second posture to the third posture; and a posture holding mechanism that holds the third posture of the manual feed tray.

4. The sheet feeder according to claim 3, wherein the link member includes a protrusion on the second end part, the manual feed tray includes an engagement hole which extends in a degree that enables the protrusion to slide in accordance with a pivoting movement of the link member while engaging the engagement hole, the posture changing mechanism includes an elastic member extending along the engagement hole, a supporting portion that supports one end of the elastic member, and a stopper piece which is fixed to another end of the elastic member and which is abuttable to the protrusion that slides inside the engagement hole, the elastic member holds the stopper piece in an extended state when the manual feed tray is assuming the second posture, and the protrusion slides inside the engagement hole in accordance with a pivoting movement of the manual feed tray and abuts the stopper piece when the manual feed tray changes its posture from the first posture to the second posture, while the protrusion presses the stopper piece and compresses the elastic member when the manual feed tray changes its posture from the second posture to the third posture.

5. An image forming apparatus comprising:

an apparatus main body;

an image forming section that is arranged in the apparatus main body and that forms an image on a sheet;

a cover member that is provided so as to be openable and closeable with respect to the apparatus main body and that has a sheet conveying path for conveying the sheet to the image forming section; and a sheet feeder that feeds the sheet to the image forming section, wherein a first conveying roller for conveying the sheet is provided on the sheet conveying path, a second conveying roller that contacts the first conveying roller at a predetermined contact pressure is arranged on a side of the apparatus main body, and the sheet feeder includes:

a sheet feeding mechanism that is arranged in the apparatus main body and that feeds the sheet in a predetermined direction, a manual feed tray that is pivotably provided on the cover member so as to be openable/closeable, that has a sheet mounting surface on which the sheet to be fed is mounted, and that is pivotably mounted to the apparatus main body, the manual feed tray being configured to assume a first posture in which the manual feed tray becomes closed with respect to the cover member, and to pivot and assume a second posture in which the manual feed tray becomes open with respect to the cover member when in use during which the sheet is mounted on the sheet mounting surface;

a link member that couples the cover member with the manual feed tray, the link member being pivotably mounted to the cover member and pivoting in accordance with a pivoting movement of the manual feed tray to hold the second posture of the manual feed tray;

a posture changing mechanism that permits the manual feed tray to pivot further in an opening direction from the second posture when a load acts on the sheet mounting surface in a state where the manual feed tray is assuming the second posture, and that causes the manual feed tray to assume a third posture while the manual feed tray is held by the link member; and a posture holding mechanism that holds the third posture of the manual feed tray, wherein the manual feed tray includes a downstream-side edge part positioned on a downstream side in a feeding direction of the sheet fed from the sheet mounting surface to the sheet feeding mechanism, and a protruding piece which is formed at the downstream-side edge part and which protrudes toward the side of the sheet mounting surface, the housing includes a claw part that engages with the protruding piece when the manual feed tray has assumed the third posture while the claw part does not engage with the protruding piece when the manual feed tray has assumed the second posture, the claw part holds the manual feed tray in the third posture in a state where the claw part engages the protruding piece, and the posture holding mechanism includes the claw part and the protruding piece.

6. The image forming apparatus according to claim 5, wherein the third posture is a posture in which the manual feed tray is held in an approximately horizontal direction.

7. An image forming apparatus comprising:

an apparatus main body;

an image forming section that is arranged in the apparatus main body and that forms an image on a sheet;

a cover member that is provided so as to be openable and closeable with respect to the apparatus main body and that has a sheet conveying path for conveying the sheet to the image forming section; and a sheet feeder that feeds the sheet to the image forming section, wherein a first conveying roller for conveying the sheet is provided on the sheet conveying path, a second conveying roller that contacts the first conveying roller at a predetermined contact pressure is arranged on a side of the apparatus main body, and the sheet feeder includes:

a sheet feeding mechanism that is arranged in the apparatus main body and that feeds the sheet in a predetermined direction, a manual feed tray that is pivotably provided on the cover member so as to be openable/closeable, that has a sheet mounting surface on which the sheet to be fed is mounted, and that is pivotably mounted to the apparatus main body, the manual feed tray being configured to assume a first posture in which the manual feed tray becomes closed with respect to the cover member, and to pivot and assume a second posture in which the manual feed tray becomes open with respect to the cover member when in use during which the sheet is mounted on the sheet mounting surface;

a link member including a first end part pivotably mounted to the cover member and a second end part mounted to the manual feed tray, the link member pivoting in accordance with a pivoting movement of the manual feed tray to hold the second posture of the manual feed tray; and a posture changing mechanism that permits the manual feed tray to pivot further in an opening direction from the second posture when a load acts on the sheet mounting surface in a state where the manual feed tray is assuming the second posture, and that causes the manual feed tray to assume a third posture while the manual feed tray is held by the link member, the posture changing mechanism including a biasing mechanism which biases the second end part of the link member so that the second posture of the manual feed tray is maintained when the manual feed tray assumes the second posture while being subjected to a first load, and whose biasing force that biases the second end part yields when the manual feed tray is subjected to a second load that exceeds the first load and changes its posture from the second posture to the third posture; and a posture holding mechanism that holds the third posture of the manual feed tray.

8. The image forming apparatus according to claim 7, wherein the link member includes a protrusion on the second end part, the manual feed tray includes an engagement hole which extends in a degree that enables the protrusion to slide in accordance with a pivoting movement of the link member while engaging the engagement hole, the posture changing mechanism includes an elastic member extending along the engagement hole, a supporting portion that supports one end of the elastic member, and a stopper piece which is fixed to another end of the elastic member and which is abuttable to the protrusion that slides inside the engagement hole, the elastic member holds the stopper piece in an extended state when the manual feed tray is assuming the second posture, and the protrusion slides inside the engagement hole in accordance with a pivoting movement of the manual feed tray and abuts the stopper piece when the manual feed tray changes its posture from the first posture to the second posture, while the protrusion presses the stopper piece and compresses the elastic member when the manual feed tray changes its posture from the second posture to the third posture.

* * * * *